United States Patent [19]

Taylor

[11] Patent Number: 4,763,591

[45] Date of Patent: Aug. 16, 1988

[54] ADJUSTABLE HARNESS LINE FOR SAILBOARDING

[76] Inventor: David Taylor, 3169 Seabury St., Carlsbad, Calif. 92008

[21] Appl. No.: 136,194

[22] Filed: Dec. 21, 1987

[51] Int. Cl.[4] ..... B63B 35/00

[52] U.S. Cl. ..... 114/39.2; 182/3

[58] Field of Search ..... 114/39.1, 39.2, 102, 114/103, 97, 90; 182/3; 24/230.5 R, 305; 5/81 R, 87

[56] References Cited

U.S. PATENT DOCUMENTS 4,516,295 5/1985 McCoy ..... 114/39.2

FOREIGN PATENT DOCUMENTS 2480703 10/1981 France ..... 114/39.2

*Primary Examiner*—Sherman D. Basinger
*Assistant Examiner*—Jesus D. Sotelo
*Attorney, Agent, or Firm*—Charles C. Logan, II

[57] ABSTRACT

An adjustable harness line for sailboarding that is attached to the boom of the sailboard. The adjustable harness line has a predetermined length of plastic tubing that has a first Velcro strap assembly attached to its one end. The opposite end of the plastic tubing has a pull down power strap attached thereto. This pull down power strap is threaded through the male portion of a buckle assembly and the female portion of the buckle assembly is attached to a second Velcro strap assembly. The two strap assemblys are detachably secured to the boom of the sailboard between 80 and 90 centimeters apart from each other. A hand loop is formed in one end of the pull down power strap which allows for the length of the harness line to be quickly shortened while sailboarding. The person sailboarding wears a harness around their waist or hips having a hook extending outwardly from the front of their body. This hook is used to engage the central area of the plastic tubing to connect the sailboarder to the boom of the sailboard.

5 Claims, 1 Drawing Sheet

ADJUSTABLE HARNESS LINE FOR SAILBOARDING

BACKGROUND OF THE INVENTION

The invention relates to sailboarding and more specifically to an adjustable harness line that a person using the sailboard attaches between themselves and the boom of the sailboard.

In the past various types of harness line have been used while sailboarding. A typical harness consists of a padded vest with a hook in front for lines that you attach to either side of the boom. This padded vest is similar in appearance to a life preserver vest. Another type of harness that won't compress your ribs is the hip harness. It is fitted over the buttocks and hips and this directs the strain to the sturdy hip bone and gives better balance and rig control than chest harnesses.

The harness line is attached to the boom with straps. These straps are positioned between 80 and 90 centimeters apart. These harness lines are fairly heavy and stiff so that they do twist around the boom. the lines must not be too thick so that they can easily be hooked in and out of attachment with the hook of the harness.

The distance that the sailboarder wants to be spaced or extending from the boom sometimes varies depending on the wind conditions. It is at these times it is advantageous to be able to change the length of the harness lines and this has not been previously possible.

It is an object of the invention to provide a novel adjustable harness line for sailboarding that is easily and quickly attachable to a sailboard boom.

It is also an object of the invention to provide a novel adjustable harness line for a sailboard that is easily lengthened and shortened in accordance with the varying wind conditions while sailboarding.

It is another object of the invention to provide a novel adjustable harness line for sailboarding that is economical to manufacture and market.

It is an additional object of the invention to provide a novel adjustable harness line for sailboarding made of materials than can withstand the corrosion of salt water.

SUMMARY OF THE INVENTION

Applicant's novel adjustable harness line for sailboarding utilizes a predetermined length of plastic tubing that is flexible enough to bend downwardly under its own weight but sufficiently rigid enough not to bet entangled on the boom. One end of the plastic tubing has a first Velcro strap assembly attached thereto. The other end of the plastic tubing has a pull down power strap attached thereto. The pull down power strap is threaded through slots in the male portion of a buckle assembly. The female portion of the buckle assembly is attached to a second Velcro strap assembly. The Velcro strap assemblys are quickly and easily attached and detached from the boom of the sailboard. The pull down power strap has a hand loop formed in one end which allows the sailboarder to quickly grab it and pull downwardly on the pull down power strap which will cause the length of the harness line to be shortened when so desired. It is also easy to quickly lengthen the harness line. The plastic tubing has a sufficient rigidity yet flexibility to absorb the shock of wind gusts while sailboarding.

DESCRIPTION OF THE PREFERRED EMBODIMENT

Figure 1:
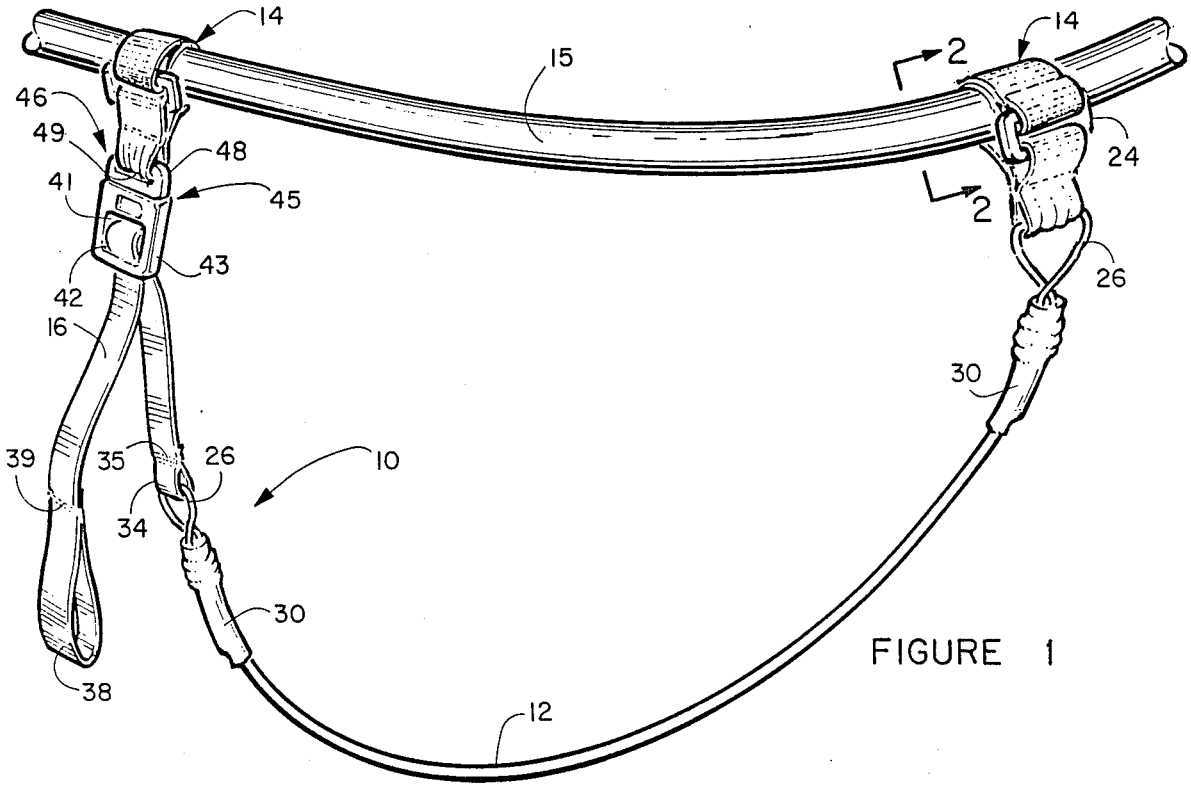
FIG. 1 is a top plan view illustrating the applicant's novel adjustable harness line attached to the boom of a sailboard.
Figure 2:
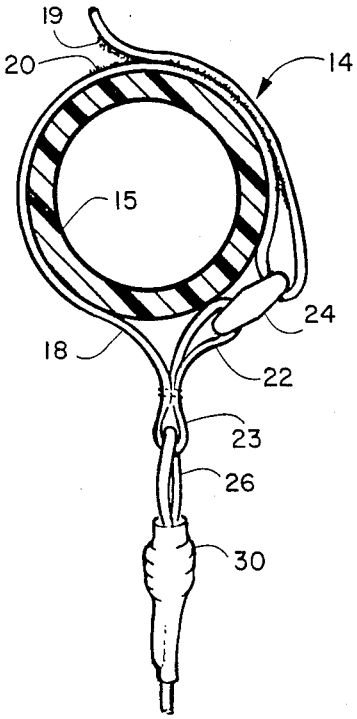
FIG. 2 is a cross sectional view taken along lines 2—2 of FIG. 1.
Figure 4:
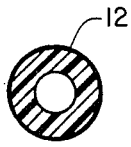
FIG. 4 is a cross sectional view taken along lines 4—4 of FIG. 1; and FIG. **4*a*** is a cross sectional view taken of an alternative structure for the plastic tubing.
Figure 3:
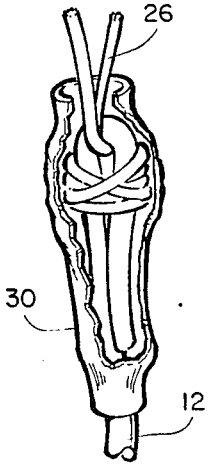
FIG. 3 is an enlarged view taken along circle 3—3 with portions broken away for clarity.
Figure 5:
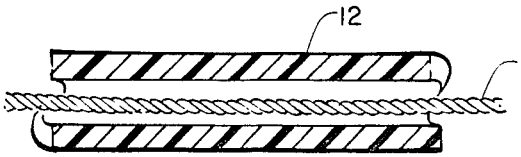

Applicant's novel adjustable harness line for sailboarding will now be described by referring to FIGS. 1–4 of the drawing. The adjustable harness line is generally designated numeral 10.

Adjustable harness line 10 is formed from a plastic tubing 12 having a strap assembly 14 attached to its one end and a pull down power strap 16 attached to its other end. Strap assembly 14 is formed from a predetermined length of woven nylon strap 18. Its one side has Velcro hook portions 19 and open loop portions 20 stitched thereto. The bottom end of strap 18 has been folded back upon itself to form a pair of closed fabric loops 22 and 23. A plastic loop buckle 24 is captured in closed loop 22. The strap assembly is attached to the boom 8 of the sailboard by wrapping strap 18 therearound and threading it through plastic loop buckle 24 and then back upon itself where the Velcro fastening structure is pressed into contact together. Woven nylon cord 26 is passed through closed loop 23 and its opposite ends are secured to plastic tubing 12 in the manner illustrated in FIG. 3. One end of plastic tube 12 is folded back upon itself and woven nylon cord 26 is wound around the doubled over end and secured thereto. A heat shrink plastic sleeve 30 slips over this structure.

Attached to the other end of plastic tubing 12 is pull down power strap 16. It is formed of an elongated woven nylon strap 33 whose top end has been folded back upon itself to form a closed fabric loop 34 secured by stitching 35. The bottom end of strap 33 is also folded back upon itself to form a hand loop 38 that is secured by stitching 39.

The intermediate portion of pull down power strap 16 passes through slots 41 and 42 of the female portion 43 of buckle assembly 45. Male portion 46 of buckle assembly 45 has a tongue 48 and a slot 49. A strap assembly 15 identical to strap assembly 14 has one of its closed fabric loops passing through slot 49 of buckle assembly 45.

It is thus readily understandable how the length of the harness line can be shortened by pulling on the down pull power strap 16 and the harness line can be lengthened by releasing more length of the strap 33 through slot 49 of the buckle assembly 45.

An alternative structure for the tubing is illustrated in FIG. **4*a***. It has a strand of metal wire passing through the bore of the tube to give it added strength.

What is claimed is:

1. An adjustable harness line for sailboarding comprising:

a predetermined length of plastic tubing having a first end and a second end;

a first predetermined length of cord that is formed into a closed loop with its ends being firmly attached to said first end of said plastic tubing;

a second predetermined length of cord that is formed into a closed loop with its ends being firmly attached to said second end of said plastic tubing;

a first strap assembly formed of a predetermined length of strap and having two closed loops formed adjacent its one end, said first length of cord threaded through one of said closed loops and a plastic loop buckle being captured in said second closed loop;

a buckle assembly having a male portion and female portion, a slot is formed adjacent the end of said male portion;

a second strap assembly formed of a predetermined length of strap and having two closed loops formed adjacent its one end, a plastic loop buckle being captured in one of said closed loops, the second closed loop passing through the slot in the male portion of said buckle assembly;

a pull down power strap having a predetermined length, a hand loop is formed in one end of said pull down power strap and the other end of said power strap has a closed loop through which said second predetermined length of cord is threaded; and said female portion of said buckle assembly having a pair of slots oriented parallel to each other through which said pull down power strap is threaded for lengthening or shortening said adjustable harness line.

2. An adjustable harness line for sailboarding as recited in claim 1 further comprising Velcro fastening means attached to one end of said first strap assembly for detachably securing said first strap assembly to the boom of a sailboard.

3. An adjustable harness line for sailboarding as recited in claim 1 wherein said first and second length of cord are made of nylon material.

4. An adjustable harness line for sailboarding as recited in claim 1 further comprising a wire extending through the entire length of said plastic tubing to give additional strength to said harness line.

5. An adjustable harness line for sailboarding as recited in claim 1 wherein said pull down power strap is made of woven nylon.

* * * * *